US007153283B1

(12) United States Patent
Triolo et al.

(10) Patent No.: US 7,153,283 B1
(45) Date of Patent: Dec. 26, 2006

(54) MASSAGE HELMET

(75) Inventors: Gabrielle H. Triolo, 1721 Neil Armstrong St., #102, Montebello, CA (US) 90640; Detlef Kramer, Lompoc, CA (US)

(73) Assignee: Gabrielle H. Triolo, Dallas, TX (US)

( * ) Notice: Subject to any disclaimer, the term of this patent is extended or adjusted under 35 U.S.C. 154(b) by 510 days.

(21) Appl. No.: 10/753,670

(22) Filed: Jan. 8, 2004

Related U.S. Application Data

(63) Continuation-in-part of application No. 10/281,413, filed on Oct. 28, 2002, now abandoned.

(51) Int. Cl.
*A61H 15/00* (2006.01)

(52) U.S. Cl. ..... 601/102; 601/103; 601/126

(58) Field of Classification Search ..... 601/12, 601/19, 84, 94, 102, 122, 124, 126, 128, 601/134, 136; 2/410
See application file for complete search history.

(56) References Cited

U.S. PATENT DOCUMENTS

| | | | | |
|---|---|---|---|---|
| 849,844 | A * | 4/1907 | Laurence | 601/136 |
| 2,247,440 | A | 7/1941 | Hempel | |
| 2,467,007 | A | 4/1949 | Boyd | |
| 3,716,048 | A | 2/1973 | Alonso | |
| 4,011,862 | A | 3/1977 | Kosiak | |
| 5,081,986 | A | 1/1992 | Cho | |
| 5,245,989 | A | 9/1993 | Simon | |
| 5,277,174 | A * | 1/1994 | Schmidhauser | 601/70 |
| 5,792,174 | A | 8/1998 | Ioan | |

FOREIGN PATENT DOCUMENTS

| | | | |
|---|---|---|---|
| DE | 2300600 | A1 | 7/1974 |
| DE | 2814727 | A1 | 10/1979 |
| DE | 2815643 | A1 | 10/1979 |
| FR | 2611493 | A1 | 9/1988 |
| JP | 2002085503 | * | 3/2002 |

* cited by examiner

*Primary Examiner*—Danton Demille
*Assistant Examiner*—Manuj Agarwal
(74) *Attorney, Agent, or Firm*—Richard S. Erbe

(57) ABSTRACT

A cranial massage helmet includes a plurality of resilient massage wheels mounted on its inner surface for application to the head of a user. The massage wheels travel along a number of tracks bonded to the inner surface of the helmet. An individual stepper motor drives each wheel.

A control system, which may be contained within a hand-held controller, contains a programmed logic controller for directing drive cards that are wired to each individual motor for independent control of each massage wheel. A variety of massage modes are made possible by the control system.

The control system also includes audio components allowing a user of the helmet to select an audio program that may be heard through earphones mounted in the helmet.

17 Claims, 4 Drawing Sheets

FIG. 1
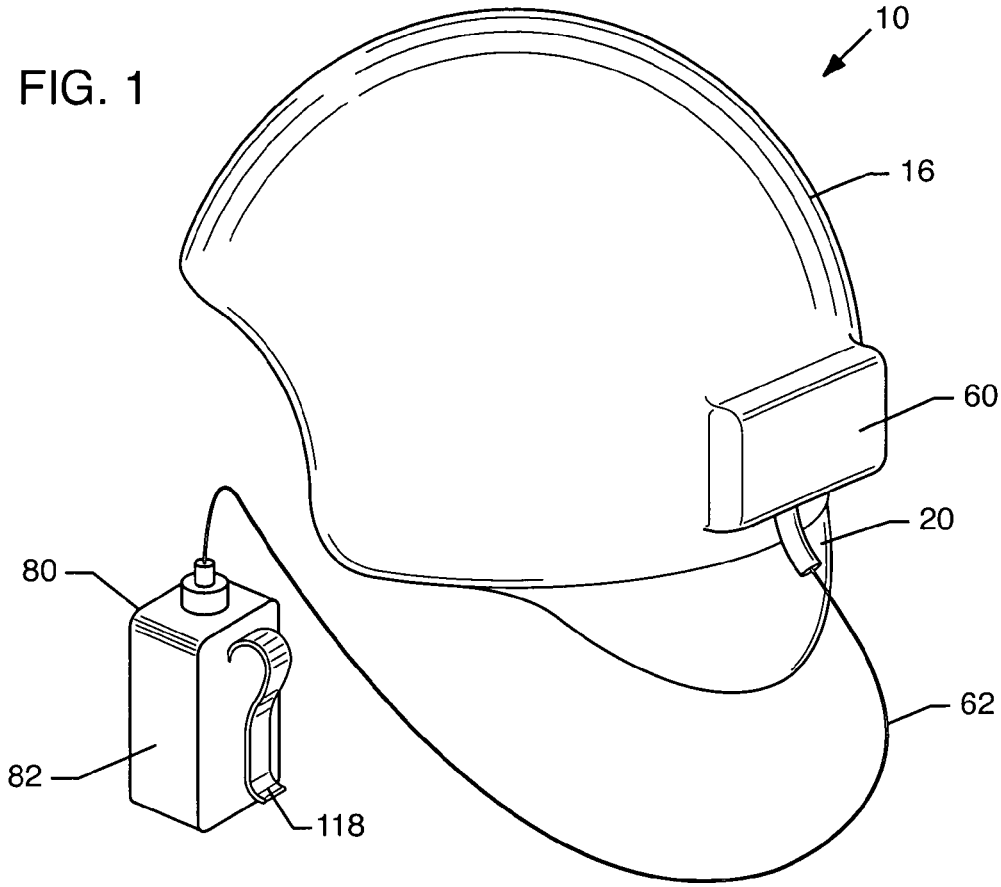
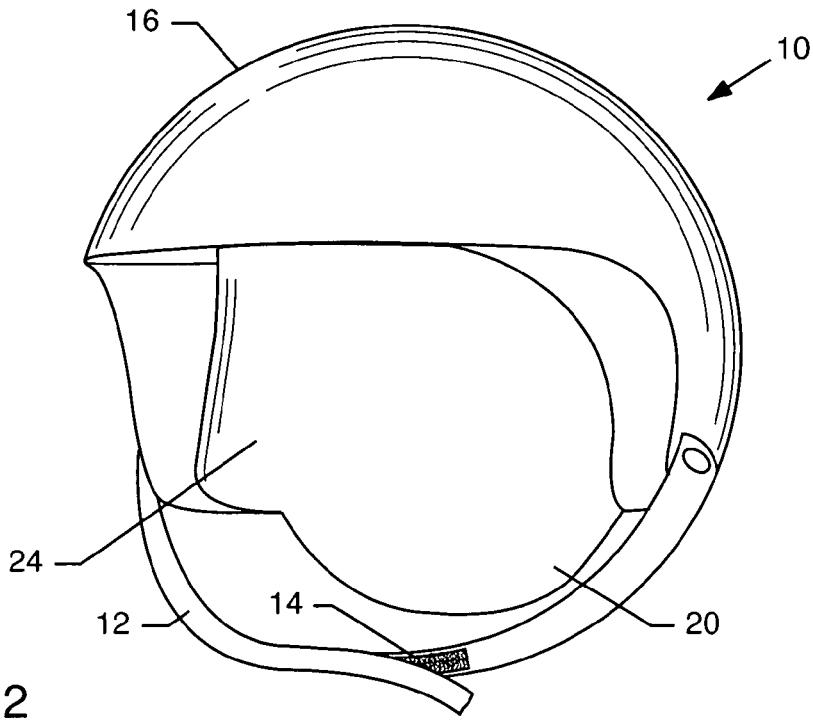
FIG. 2

MASSAGE HELMET

RELATED APPLICATIONS

This application is a continuation-in-part application of U.S. patent application Ser. No. 10/281,413 filed Oct. 28, 2002 now abandoned.

BACKGROUND OF THE INVENTION

1. Field of the Invention

The present invention relates to a cranial massage apparatus, and, more particularly, to an improved apparatus for mechanically providing a cranial massage that includes numerous modes of massage, and does not require constant attention from another person.

2. General Background and State of the Art

Headaches are a very common disorder affecting millions of people worldwide. A common cause of headaches, confirmed by years of scientific research, is dilation of the blood vessels of the head and scalp. Another very common source of headaches is tension in the muscles of the head and neck, frequently cause by stressful events.

There are numerous medications available for headache relief on the market. While many find such medications effective for providing relief from their headaches, use of such medications is not without risk due to possible toxic side effects and the possibility of adverse reaction. Many headache sufferers, therefore, prefer medication-free treatments to relieve their headaches.

Many headache sufferers often seek relief by the application of finger pressure over the areas of most severe pain. An individual can apply such pressure by himself or herself or by the assistance of another person or implement. The effectiveness of this type of manual treatment is limited because generally only a small number of pressure points can be stimulated simultaneously because of the number of fingers on, and the configuration of, the human hand. Another limitation of such manual treatments is that such treatments are time limited because of fatigue occurring in the hands and fingers.

Other headache sufferers find acupuncture and acupressure therapies safe and cost-effective alternatives. Acupuncture as a means for relief of headaches has been used successfully for many years. Acupuncture is the long-used method of employing insertion of needles into the skin at exact, spatially defined points in order to treat specific disorders Another method of headache treatment that is akin to acupuncture is acupressure, which is the application of pressure, usually by using the thumbs, at the traditional, known acupuncture points. Acupressure is frequently employed as a treatment in lieu of acupuncture. Both of these treatment techniques are widely accepted by the health care community and the public as valid forms of treatment for alleviating headaches.

A drawback to the acupuncture and acupressure techniques is that both techniques require a trained, skilled and licensed professional to provide the treatments. The individual applying the treatment must be familiar with nerve points and their location and must apply the right amount of pressure for a prescribed duration. There are a limited number of such professionals compared to the number of headache sufferers. Thus, a headache sufferer may not have ready access to such treatment alternatives when it is most needed.

To address some of the disadvantages of these treatment alternatives, there have been a number of attempts to provide mechanical devices for treating headaches. One such device is disclosed in U.S. Pat. No. 2,247,440 to Hempel. The Hempel patent discloses a device that consists of a series of bands that are applied to the head in a manner such that the head is massaged from the sides to loosen the scalp and increase blood flow in the head. The Hempel device is not directed to applying pressure to the acupressure points and is a machine that must be manipulated by another person other than the headache sufferer.

U.S. Pat. No. 2,467,007 to Boyd discloses a double-walled helmet for mounting on the head having inwardly projecting resilient head-massaging fingers mounted on the inner shell that move up and down in response to a motor mounted in the shell. The Boyd device is not easily adaptable to users of all configurations, and only provides one mode of massage. It is also complex in design. The double-walled construction adds to the weight of the device and also makes it a bit cumbersome. There is no provision to address sanitation issues when different users use the helmet. The movable fingers also expose the user to the problem of having his or her hair getting tangled in the machine.

U.S. Pat. No. 3,716,048 to Alonso discloses a semi-spherical double-walled helmet for mounting on the head. The device has an electric motor and reduction gearing in a housing at the apex of the helmet. The gearing drives a shaft, which passes through to the space between the outer and inner helmets. The shaft is connected to and drives a revolvable rigid semi-spherical shell located in bearings within the space between the helmet walls. Rubber fingers are press-fitted into holes through the inner shell of the helmet; being rubber, they are capable of limited angular movement about the hole. These fingers each have a nylon tip on the end projecting into the space between the helmet walls. The tips engage and ride in undulating grooves embossed on the movable shell. As the shell revolves, the tips are forced to move up and down by the grooves. The up and down motion in conveyed to the rubber fingers on the inside of the helmet, which massage the scalp. The Alonso device is not easily adaptable to users of all configurations, and only provides one mode of massage. It is also complex in design. The double-walled construction adds to the weight of the device and also makes it a bit cumbersome. There is no provision to address sanitation issues when different users use the helmet. The movable fingers also expose the user to the problem of having his or her hair getting tangled in the machine.

U.S. Pat. No. 5,081,986 to Cho discloses a massaging helmet that contains an endless belt, which rubs the user's head with belt areas of various textures. The belt runs over two rollers located inside the helmet near the nape and forehead. An electric motor and batteries power the belt, which rubs the scalp from front to back. The belt surface, which is made of soft plastic, has both an embossed area to mimic the human hand, and another area with rows of upright plastic fingers which comb the user's hair. The Cho device is very complex with many movable parts. It does not stimulate the movements associated with acupressure. There is no provision to address sanitation issues when different users use the helmet. The movable belts and fingers also expose the user to the problem of having his or her hair getting tangled in the machine.

U.S. Pat. No. 5,245,989 to Simon discloses a device having a plurality of individually controlled pressure applying members with a scalp-contacting member. The members are attached to a helmet or cap-like unit, each over an opening formed at locations that correspond to desired pressure points of the scalp. Each of the pressure-applying members is individually controlled. The Simon device only provides one mode of massage. The Simon device does not have any provision to address sanitation issues when different users use the helmet. The movable members also expose the user to the problem of having his or her hair getting tangled in the machine.

U.S. Pat. No. 5,792,174 to loan discloses a cap-like device for placing on the head. The device includes an outer and an inner membrane. The membranes meet and are attached at their margins, thus forming a space between them. The membranes are made of a stretchable material to enable the device to be adapted to various users. The inner membrane, which is closest to the scalp of the user, has a plurality of immobile protrusions attached to it. The protrusions come in contact with the user's scalp. The protrusions are made of hard material, either plastic or rubber. The protrusions will cover the entire surface of the inner membrane. A pump introduces air into the space between the membranes, thus forcing the immobile protrusions on the inner membrane onto the scalp. The loan device is not designed to specifically for massage, as it does not specifically apply pressure to known acupressure points. The loan device does not have any provision to address sanitation issues that occur when different users use the helmet. The immobile protrusions also expose the user to the problem of having his or her hair getting tangled in the in the device.

None of the above patents or products, taken singularly or in combination, is seen to describe the present invention as disclosed and claimed.

SUMMARY OF THE INVENTION

It is therefore an object of the present invention to provide a mechanical massage device.

Another object of the invention is to provide a mechanical massage device for wearing on the head of the user.

A further object of the invention is to provide a mechanical massage device that is very easy to construct, without complicated mechanical or electronic parts or systems.

Yet another object of the invention is to provide a mechanical massage device that is durable and light in weight.

Still another object of the invention is to provide a mechanical massage device that provides a massage substantially equivalent to the expert massage provided by a trained masseur.

Yet a further object of the invention is to provide a mechanical massage device that is safe to use and addresses sanitation issues caused when multiple users use the same device.

Another object of the invention is to provide a mechanical massage device that may be used by users of all different sizes without requiring adjustments to the components of the device.

It is an object of the invention to provide a mechanical massage device that will not subject the user to having his or her hair entangled in the device.

A further object of the invention is to provide a mechanical massage device that may be controlled by the user through the use of a hand-held controller.

Still another object of the invention is to provide a mechanical massage device that utilizes multiple modes of massage.

Another object of the invention is to provide a mechanical massage device that provides the user with the ability to select an audio entertainment event while wearing the device.

Yet another object of the invention is to provide a mechanical massage device that is programmable.

These and other objectives are achieved by the present invention, which, in a broad aspect, provides the user with a self contained programmable cranial massage helmet having a housing containing a plurality of tracks located at selected places in the interior of the helmet. Each track holds one or more resilient massaging wheels, each of which is driven by an individually controlled microstepper motor mounted on the massaging wheel. It is through the action of the massage wheels that massaging is performed on the wearer of the massage helmet.

Each massage wheel may be moved forward or backwards along its track and may also be programmed to oscillate in a programmed location. Foam cushioning is attached to the inner surface of the housing between the tracks. A liner is attached over the cushioning and massage wheels mounted on the interior surface of the helmet to separate the helmet components from the user's head. The liner may be cleaned or removed and replaced after each use for sanitary purposes. The liner also serves to prevent the hair of a user from becoming entangled in any of the helmet's parts.

The massage helmet includes a control system contained in a separate hand-held controller. The control system components are mounted separately from the helmet to reduce the weight of the helmet on the wearer's head.

The control system includes a programmed logic controller, which can independently control the movement of each individual motor and massage wheel. Thus, it is possible for a user of the invention to experience several modes of massage during a single treatment: unison, where all of the stepper motors (and hence the massage wheels) move in the same direction at the same time and reverse at the same time; random, where all of the massage wheels are moved at the same rate but not in the same direction and reverse direction independently; point massage, where all of the massage wheels oscillate over various acupressure points for a period of time and then move on to the next point; pause, where all of the massage wheels stop traveling and oscillating; and timer, where the user can control the duration of the massage.

The massage helmet of the present invention also includes a pair of conventional earphones mounted in position so that when a user puts on the helmet, the earphones will be disposed adjacent the user's ears. The control system of the present invention includes the ability to provide the user with an audio entertainment event of the user's choosing. The control system includes a radio receiver for providing broadcast content, and also includes a series of stored soothing sound sequences, such as the ocean, rain, or the like, which the user may choose for listening while receiving treatment.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiment of the invention with reference to the drawings in which:

FIG. 1 illustrates a perspective view of the outside of an exemplary apparatus according to the present invention;

FIG. 2 illustrates a perspective view of the inside of an exemplary apparatus according to the present invention with the foam cushioning and liner in place;

DETAILED DESCRIPTION OF THE PREFERRED EMBODIMENT OF THE INVENTION

In the following description of the present invention, reference is made to the accompanying drawings, which form a part thereof, and in which are shown, by way of illustration, an exemplary embodiment illustrating the principles of the present invention and how it may be practiced. It is to be understood that other embodiments may be utilized to practice the present invention, and structural and functional changes may be made thereto without departing from the scope of the present invention.

Figure 3:
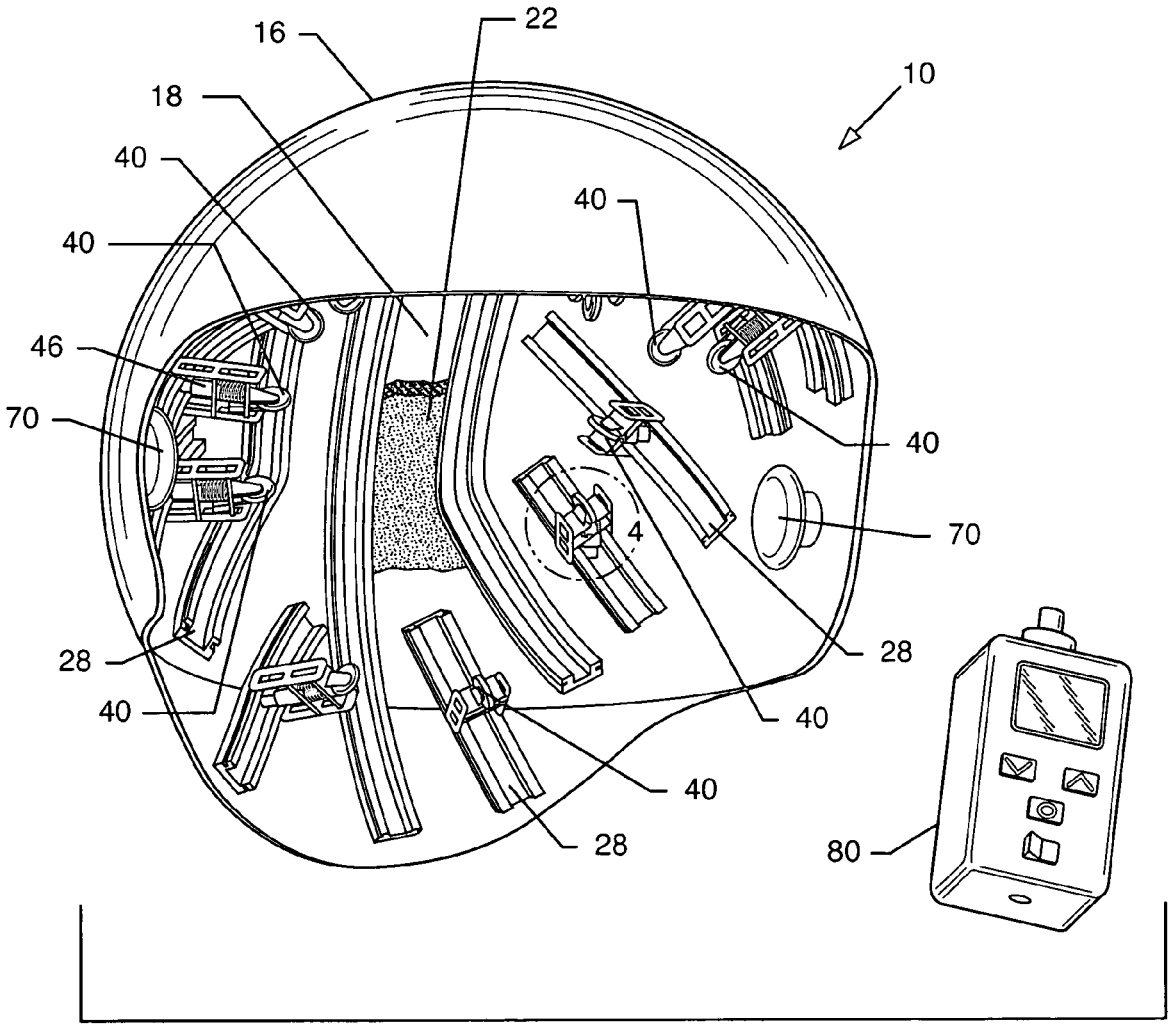
FIG. 3 illustrates a perspective view of the inside of an exemplary apparatus according to the present invention with most of the foam cushioning and liner removed to show the plurality of massage wheels and tracks on the inside of the invention.

In that form of the present invention chosen for purposes of illustration, FIGS. 1–3 show a self-contained programmable cranial massage helmet generally referred to by the reference numeral 10, having a chin strap 12 which is secured by releasable fastening means 14 to retain helmet 10 on the head of a user. In the preferred embodiment of the invention, fastening means 14 includes a pair of opposed Velcro strips, although other types of fasteners may be used. Helmet 10 extends from the forehead of the user to below the nape of the neck at nape skirt 20 and below each ear. At the back of helmet 10 is junction box 60, which connects to hand-held controller 80 through controller wire 62.

As best illustrated in FIG. 3, helmet 10 includes outer surface 16 and inner surface 18. A plurality of tracks, each of which is designated by the numeral 28, is attached to inner surface 18. Tracks 28 may be constructed of a variety of materials, such as a lightweight metal or a molded plastic. A plurality of massage wheels 40 travels along tracks 28, providing the massaging action. FIG. 3 also shows a portion of the foam cushioning 22 that is bonded to inner surface 18 of helmet 10. Cushioning 22 covers the entire inner surface 18 that is not covered by tracks 28.

FIG. 2 shows a front view of helmet 10 with a liner 24 in place covering foam cushioning 22, thus providing comfort to a user. A removable soft material forms liner 24 between a user's scalp and massage wheels 40 and cushioning 22 to prevent a user's hair from getting tangled up in the massage wheels. Liner 24 may be removed and replaced or cleaned between each treatment, thus overcoming any concerns an individual may have about using helmet 10 after another individual has used it. Liner 24 may be secured to helmet 10 in a variety of ways, such as snaps or Velcro.

Figure 4:
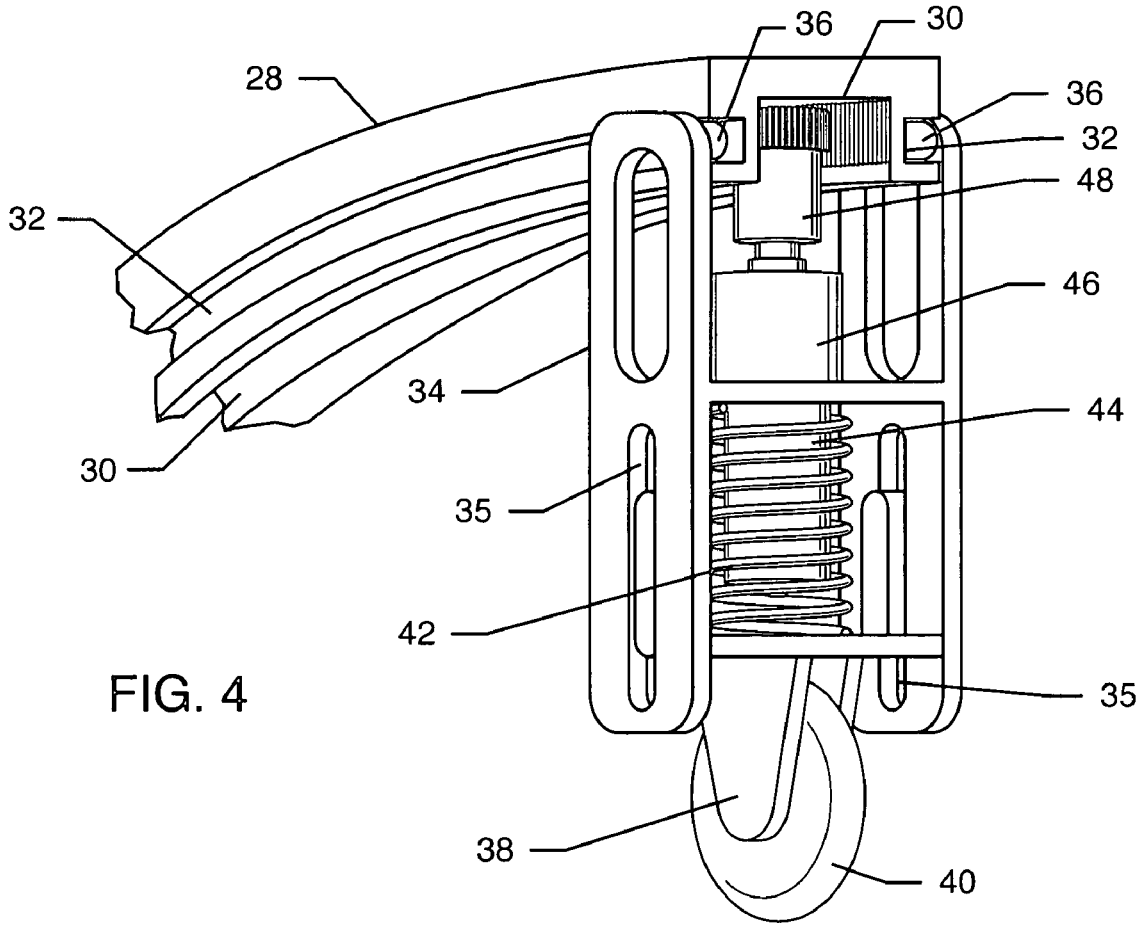
FIG. 4 illustrates sectional view taken at circle 4 in FIG. 3.

As illustrated in FIG. 4, mounted onto each track 28 is one or more massage wheels, each of which is designated by the numeral 40. The massage wheels 40 actually perform the massaging by rolling along and oscillating on the various known acupressure points on the scalp and neck. A motor 44 drives each massage wheel 40. Track 28 is bent to the contour of inner surface 18. Not all tracks are of the same shape or length. Each track 28 includes a rack 30 along its curvature that engages motor drive gear 48, as will be explained further.

Each massage wheel 40 and motor 44 are mounted inside a mounting frame 34 by means of suspension frame 38. Mounting frame 34 includes four guide pins 36 that engage guide slots 32 found on either side of track 28. Tracks 28 are positioned on the inner surface 18 of helmet 10 so that massage wheels 40 will travel over the acupressure points.

Massage wheel 40, motor 44 and reduction gear head 46 are secured by suspension frame 38 to mounting frame 34. Suspension frame 38 enables massage wheel 40 to move up and down by sliding in slots 35 in mounting frame 34. Spring 42 positioned between mounting frame 34 and suspension frame 38 acts as a suspension system for massage wheel 40. Drive gear 48 is fastened to gear head 46 to engage the teeth of rack 30 in track 28 to provide forward and backward movement along the track to the mounting frame 34, and hence to massage wheel 40.

In the preferred embodiment of the invention, each motor 44 is a micro-stepper motor. While stepper motors are well known, they are of particular importance and provide numerous advantages when incorporated in the present invention. Stepper motors do not require limit switches or clutches to perform the motions required in utilizing the present invention. A stepper motor has a number of magnets inside it. As the stepper motor turns, each magnet is counted as one step by the motor's drive electronics. If, as in the present invention, a motor 44 has to move down a track 28 that requires one hundred steps, a computer, called a programmable logic control (PLC), will know where the motor 44 is by the number of steps counted. The PLC can then tell the motor drive electronics to stop motor 44 at exactly one hundred steps, reverse direction, or oscillate back and forth. One PLC can control multiple stepper motors.

Figure 6:
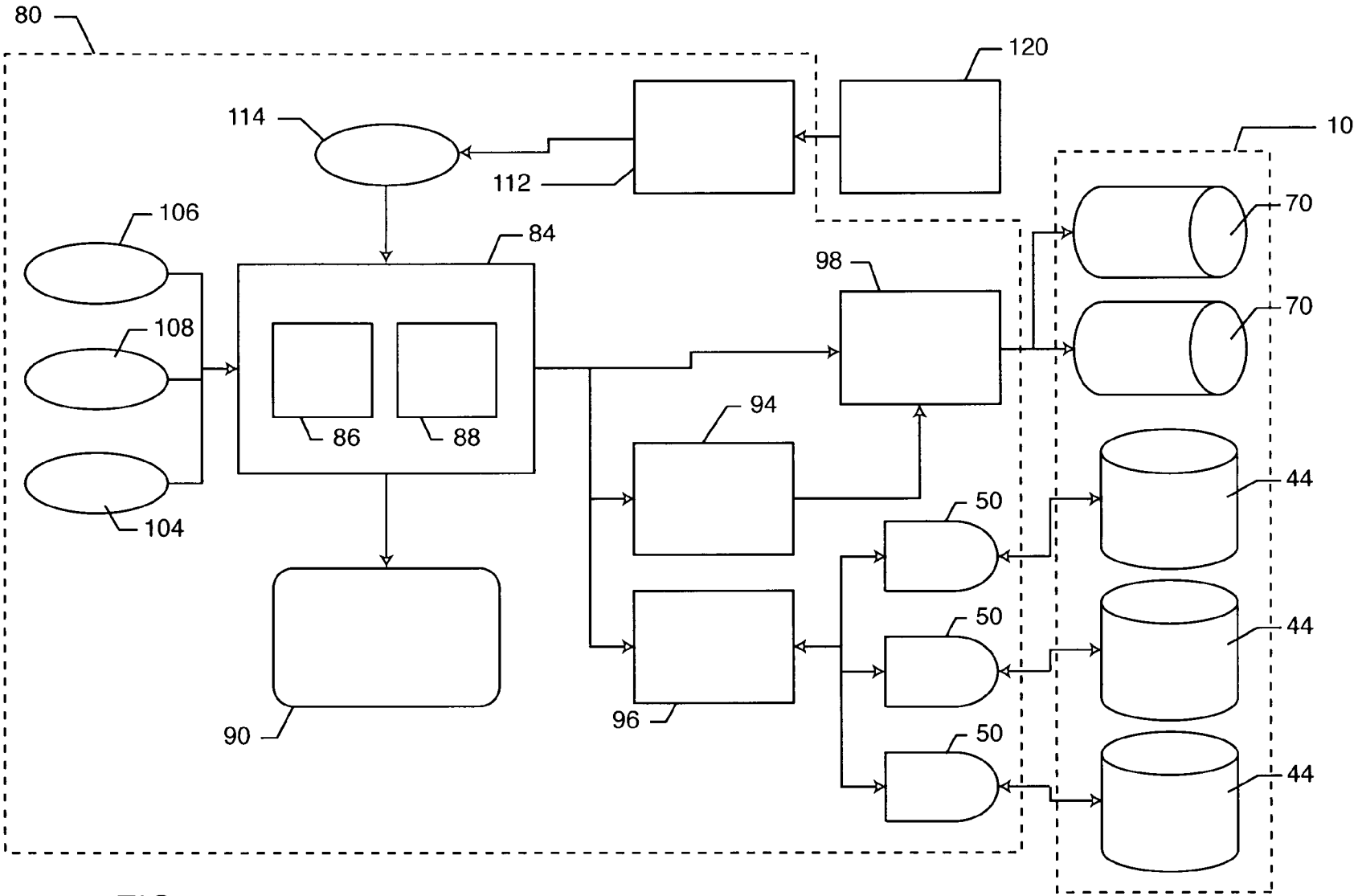
FIG. 6 illustrates a schematic of the control system of an exemplary apparatus according to the present invention.

FIG. 6 illustrates the control system for the preferred embodiment of the present invention. While the control system components may be located in a variety of locations, in the preferred embodiment of the invention most of the control system components are housed in a hand-held controller 80 having a display 90. A control card 84 mounted in controller 80 is comprised of a central processing unit 86 and memory 88. Central processing unit 86 will contain the computer operating system and will direct inputs from control buttons mounted on controller 80. Memory 88, which in the preferred embodiment of the invention is a ROM chip, contains several programmed massage modes and a number of sequences of soothing nature sounds. While controller 80 is able to perform a variety of tasks, in the preferred embodiment of the invention, it primarily performs the main functions of providing motor control, display control, and sound control.

In performing the motor control function, memory 88 provides input to programmable logic controller 96, which in turn provides input to a plurality of motor drive cards 50, with an individual drive card 50 controlling each individual motor 44. Those skilled in the art will recognize that one or more drive cards could be used for the application, without departing from the scope of the invention. Drive cards 50 may be mounted injunction box 60 on helmet 10 or in controller 80 without diminishing functionality. In the preferred embodiment of the invention, drive cards 50 are located in controller 80 to reduce the weight of helmet 10.

Each drive card 50 directs its respective motor 44 to perform its sequence of movements in accordance with instructions from programmable logic controller 96. Controller 80 makes it possible for the user of helmet 10 to program a variety of massage modes during a treatment in accordance with the user's preferences. As discussed previously, very precise control of each motor 44 and its associated massage wheel 40 is possible by drive card 50 counting the number of steps its respective motor 44 has taken. Drive cards 50 are connected to motors 44 with wiring that delivers data and power to motors 44 through controller wire 62.

Through use of the control system of the present invention, helmet 10 can provide a variety of massage modes. In the Unison mode, all motors 44 move in the same direction at the same time and reverse direction at the same time. In the Random mode, all motors 44 move at the same rate but not in the same direction and reverse direction independently of each other. In the Point Massage mode, all motors 44 oscillate over various acupressure points for a programmed period of time, then move to the next acupressure point. The sequence is then repeated in the reverse direction. Two other modes possible with the present invention are Timer mode, for selecting a specific period of time for treatment, and Pause mode, where the treatment is interrupted for a period of time at the user's discretion.

The present invention also provides the user with the opportunity to receive audio input during a treatment through earphones 70. As previously discussed, memory 88 contains a number of sound sequences which may be selected by a user during a treatment. Alternatively, controller 80 also contains radio receiver 94, which allows a user to listen to broadcast programming if he or she chooses. A user selects sounds or broadcast using controller 80. The selected output, either sounds or broadcast, it directed to amplifier 98, which is coupled to earphones 70.

Controller 80 may be powered by household current or a rechargeable battery. In the preferred embodiment of the invention, controller 80 is powered by a rechargeable nickel-cadmium battery 112. Battery 112 may be recharged by use of a conventional recharging circuit 120 through charging port 116 in controller 80.

Figure 5:
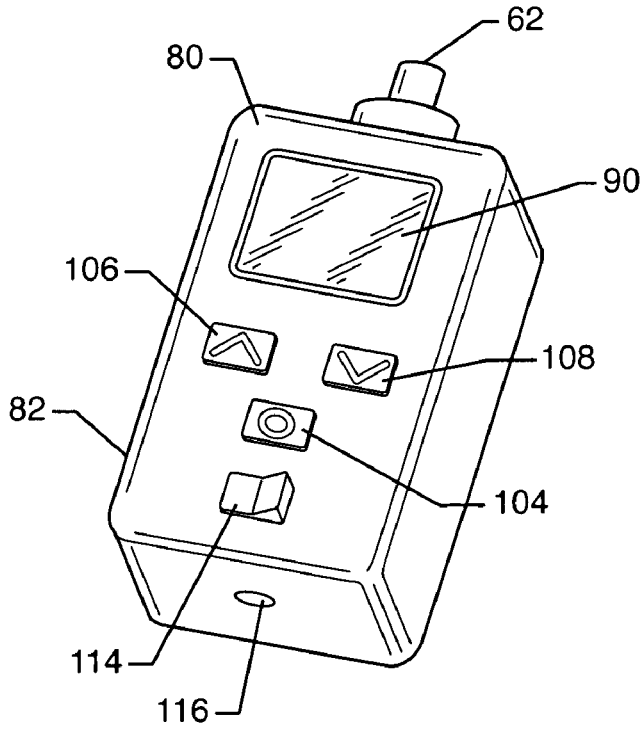
FIG. 5 illustrates a view of the front of the hand-held controller for controlling an exemplary apparatus according to the present invention.

FIG. 5 illustrates hand-held controller 80, which is enclosed in a housing 82. On the surface of housing 82 is display 90 in the form of a liquid crystal display. Display 90 allows a user of helmet 10 to view massage modes or sound selections. Power switch 114 provides on-off control of power to the controller 80 and helmet 10.

Also contained on housing 82 are menu/set button 104 and two scroll buttons, scroll up button 106 and scroll down button 108. These three buttons provide a user of helmet 10 with the ability to select the desired mode of massage and the desired audio presentation that he or she wishes to hear.

In order to use the helmet 10 and controller 80, a user would first don helmet 10 and turn power switch 114 to the on position. The user then presses menu/select button 104 until the desired menu appears on display 90. Once the desired menu appears, the user scrolls between the choices offered in the menu by using scroll up button 106 and scroll down button 108 until the desired selection appears in display 90, then presses menu/select button 104 to make the choice.

In the preferred embodiment of the invention, the main menu shown on display 90 includes "Massage Mode", "Sounds", and "Time/Date". Under Massage Mode, the submenu includes the choices "Unison", "Random", "Point Massage", "Timer" and "Pause", as previously noted. Under Sounds, the submenu includes "Volume", "Radio" and "Soothing". "Radio" and "Soothing" will include their own submenus allowing the user the choice of a wide variety of audio programming. Those skilled in the art will recognize that various other control modes and menus could be controlled by controller 80 without departing from the scope of the invention.

While a user is undergoing a treatment, controller 80 may be placed in his or her lap or other convenient location, or it could be secured to a user's belt by means of belt clip 118 shown in FIG. 1.

Those skilled in the art will recognize that all of the components of the control system are available from a wide variety of known sources, such as MicroMo Electronics or GE Fanuc.

The foregoing description of an exemplary embodiment of the present invention has been presented for purposes of enablement, illustration, and description. It is not intended to be exhaustive of or to limit the present invention to the precise form discussed. There are, however, other configurations for mechanical massage devices not specifically described herein, but with which the present invention is applicable. The present invention should therefore not be seen as limited to the particular embodiment described herein; rather, it should be understood that the present invention has wide applicability with respect to mechanical massage devices. Such other configurations can be achieved by those skilled in the art in view of the description herein. Accordingly, the scope of the invention is defined by the following claims.

What is claimed is:

1. A cranial massage helmet comprising:

a housing having an inner surface and an outer surface;

a plurality of tracks attached to said inner surface;

at least one wheel resiliently mounted on each of said tracks and movable along said tracks;

said at least one wheel is mounted in a wheel carrier;

a rack mounted on each of said tracks; and at least one stepper motor for driving each of said wheels.

2. The helmet according to claim 1 wherein said tracks cover a plurality of the acupressure points on the human head.

3. The helmet according to claim 1 further comprising:

cushioning foam attached to said inner surface between said plurality of tracks; and a liner positioned over said foam and said at least one wheels.

4. The helmet according to claim 1 further comprising a chinstrap to secure said helmet on the head of a user.

5. The helmet according to claim 1 wherein said stepper motors impart forward, backward and oscillating movement to said wheels.

6. The helmet according to claim 1 wherein said wheel carrier comprises:

a mounting frame attached to said track;

a suspension frame slidably mounted to said mounting frame; and a spring mounted to said suspension frame for imparting upward and downward movement to said wheel.

7. The helmet according to claim 1 further having a plurality of earphones attached to said inner surface.

8. The helmet according to claim 1 further comprising a controller for controlling said motors.

9. The helmet according to claim 8 wherein said controller comprises:

a housing;

a display on said housing;

a power switch on said housing;

control buttons on said housing; and a control system mounted within said housing.

10. The helmet according to claim 9 wherein said control system comprises:

a control card having a central processing unit and memory;

a programmed logic controller for receiving input from said control card;

a plurality of drive cards for receiving input from said programmed logic controller and providing output to said motors; and a sound circuit for receiving input from said control card.

11. The helmet according to claim 10 wherein said sound circuit comprises:

an amplifier for outputting audio from said controller;

a plurality of audio sound events stored in said memory, said memory coupled to said amplifier; and a radio receiver mounted within said housing and coupled to said amplifier.

12. The helmet according to claim 8 further comprising a junction box on said outer surface.

13. The helmet according to claim 12 further comprising a wire for transmitting power and data to between said controller and said junction box.

14. The helmet according to claim 9 wherein said control buttons comprise:

a menu/select button;

a scroll up button; and a scroll down button.

15. The helmet according to claim 10 wherein said control system enables the selection of a plurality of massage modes.

16. The helmet according to claim 15 wherein said massage modes include unison, random, point massage, timer and pause.

17. The helmet according to claim 11 wherein said control system enables the selection of a plurality of audio events.

* * * * *